US005638603A

United States Patent [19]

Li

[11] Patent Number: 5,638,603

[45] Date of Patent: Jun. 17, 1997

[54] WRAPPAGE CUTTER

[75] Inventor: Po Wen Li, Taipei, Taiwan

[73] Assignee: Prudential Co., Ltd., Taipei, Taiwan

[21] Appl. No.: 597,866

[22] Filed: Feb. 7, 1996

[51] Int. Cl.[6] ..... B26B 3/08

[52] U.S. Cl. ..... 30/280; 30/294

[58] Field of Search ..... 30/280, 289, 294, 30/2

[56] References Cited

U.S. PATENT DOCUMENTS

| | | | |
|---|---|---|---|
| 2,274,978 | 3/1942 | Currier | 30/294 |
| 2,294,018 | 8/1942 | Borst | 30/294 |
| 2,610,399 | 9/1952 | Adams et al. | 30/294 |
| 3,365,798 | 1/1968 | Cunningham | 30/294 |
| 4,001,934 | 1/1977 | Bell | 30/289 |
| 4,106,196 | 8/1978 | Smithline | 30/294 |

*Primary Examiner*—Hwei-Siu Payer

*Attorney, Agent, or Firm*—Morton J. Rosenberg; David I. Klein

[57] ABSTRACT

Disclosed is a wrappage cutter including a holder and a cutting element disposed below and received in the holder. The cutting element includes a blade inclinedly fixed at an angle between 15 degrees and 35 degrees relative to the holder, such that when the holder is pushed forward against a paper to be cut, the paper can be easily and straight cut in a quick and safe manner.

2 Claims, 6 Drawing Sheets

WRAPPAGE CUTTER

BACKGROUND OF THE INVENTION

There are several different ways to cut a sheet of paper. The first and the simplest way is to fold the paper against itself and then, use a knife putting between the folded paper to cut the same along the folding line. With this cutting way, the paper can be cut straight. However, this way of cutting is not suitable for a thick paper or multiple sheets of paper stacked together because the paper can not be folded to show a distinct folding line. The second way is to cut the paper with the aid of a ruler. The ruler is put on the paper against a line at where the paper is cut. Then, use a knife to cut the paper by closely abutting the blade of the knife against the ruler. With this way, the sheet or sheets of paper can be cut straight, too. However, the ruler tends to be easily damaged at two sides during cutting and might cause an error in the accuracy of straight cutting. Nevertheless, the second way of cutting is superior to the first way in that multiple sheets of paper can be cut at the same time.

To split a roll wrappage, the above-mentioned second way of cutting seems to be more suitable and acceptable than the first one. For example, a ruler can be attached to one edge of the roll wrappage, and then, the wrappage is cut along the ruler in a direction from outer end toward the roll itself. The cutting will inevitably hindered by the roll itself and to cut the paper from an outer end toward an inner end tends to dangerously injure the user.

It is therefore desirable to develop an improved cutting means for particularly using in cutting a roll wrappage.

SUMMARY OF THE INVENTION

A primary object of the present invention is to provide a wrappage cutter which includes a blade disposed inside a holder so that the whole holder can be held to quickly and safely cut a roll wrappage parallel to an edge thereof.

Another object of the present invention is to provide a wrappage cutter which includes a blade inclinedly fixed inside a holder so that a cutting edge of the cutter and the holder contain an angle of from about 15 degrees to about 35 degrees between them to provide an inclination best for cutting the paper.

BRIEF DESCRIPTION OF THE DRAWINGS

The above and other objects as well as the special structure and technical means required to achieve these objects can be best understood through the following detailed description of the preferred embodiment and the accompanying drawings, wherein.

DETAILED DESCRIPTION OF THE PREFERRED EMBODIMENT

The present invention relates to a wrappage cutter and includes a holder 1 and a cutting means 2.

Figure 1:
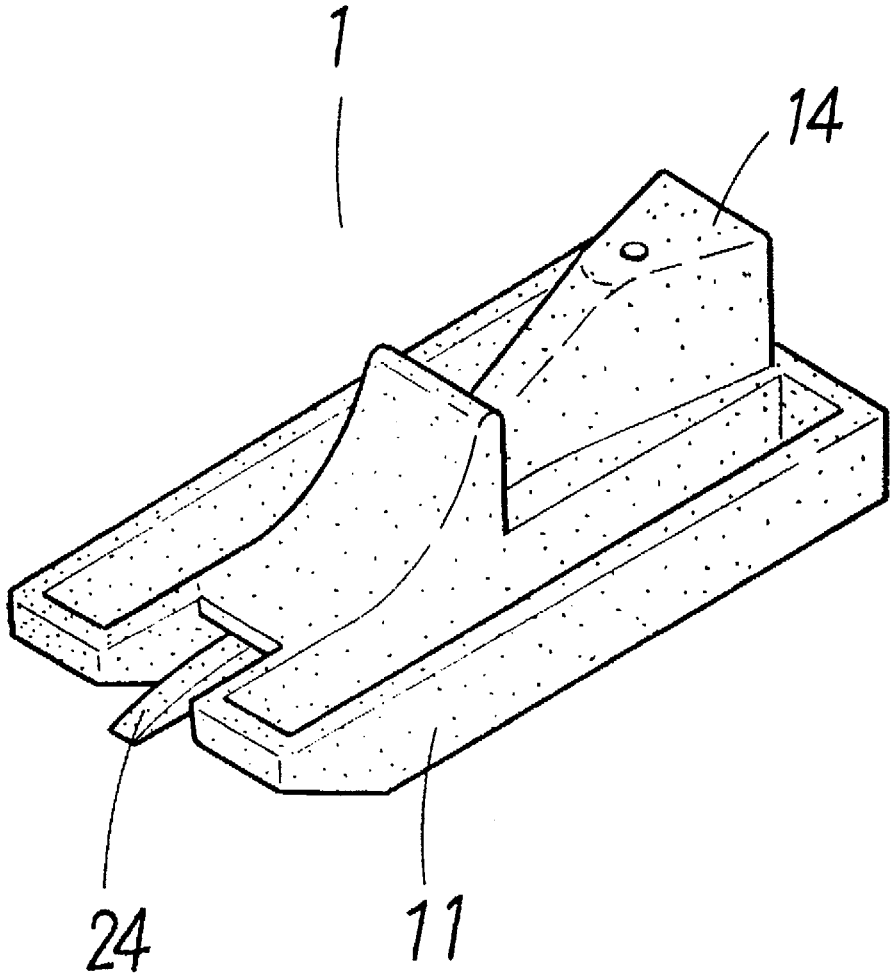
FIG. 1 is a perspective showing the present invention.
Figure 2:
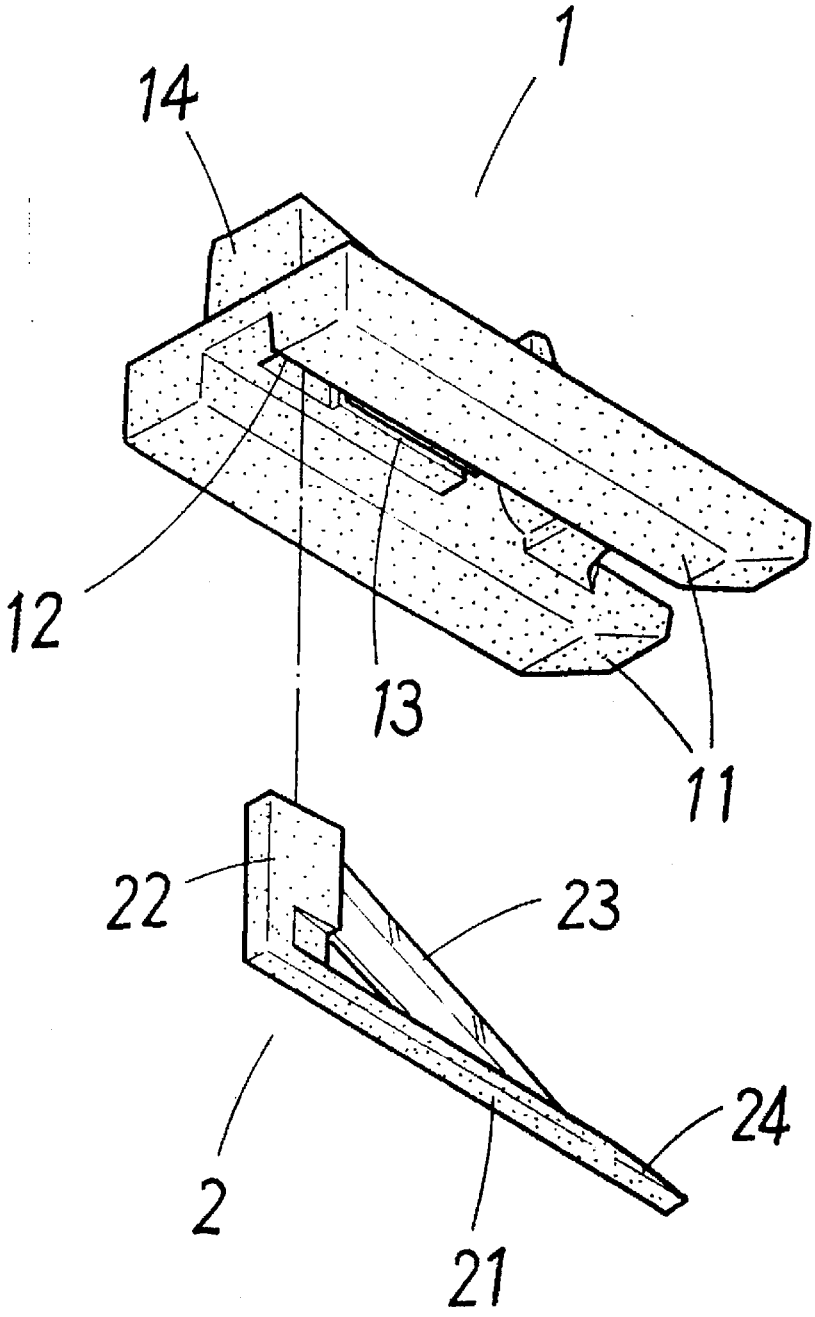
FIG. 2 is a disassembled bottom perspective view of the present invention.

Please refer to FIGS. 1 and 2. The holder 1 has two side parts 11 for fitly pressing against a paper to be cut, and middle connection part extending between the two side parts 11. The middle connection part further includes a front stop part and a rear holding part 14. The holding part 14 has a narrow front end and a wide tail end, such that it together with the stop part form a triangular holding area. As can be clearly seen from FIGS. 2 and 3, a first recess is formed between the two side parts 11 and below the middle connection part. A second recess or receiving recess 12 is further formed in the first recess to deeply extend into a bottom side of the holding part 14. A third recess or inclined blade groove 13 is also formed in the first recess but in front of the receiving recess 12 to extend forward. The receiving recess 12 and the blade groove 13 together receive the cutting means 2 therein.

The cutting means 2 includes a bottom blade holder 21, an engaging block 22 upward projected from a rear end of the blade holder 21 to together with the blade holder 21 form an L-shaped support, and a blade 23 inclinedly fixed between the upright engaging block 22 and the bottom blade holder 21. The bottom blade holder 21 has a pointed front end 24.

Figure 3:
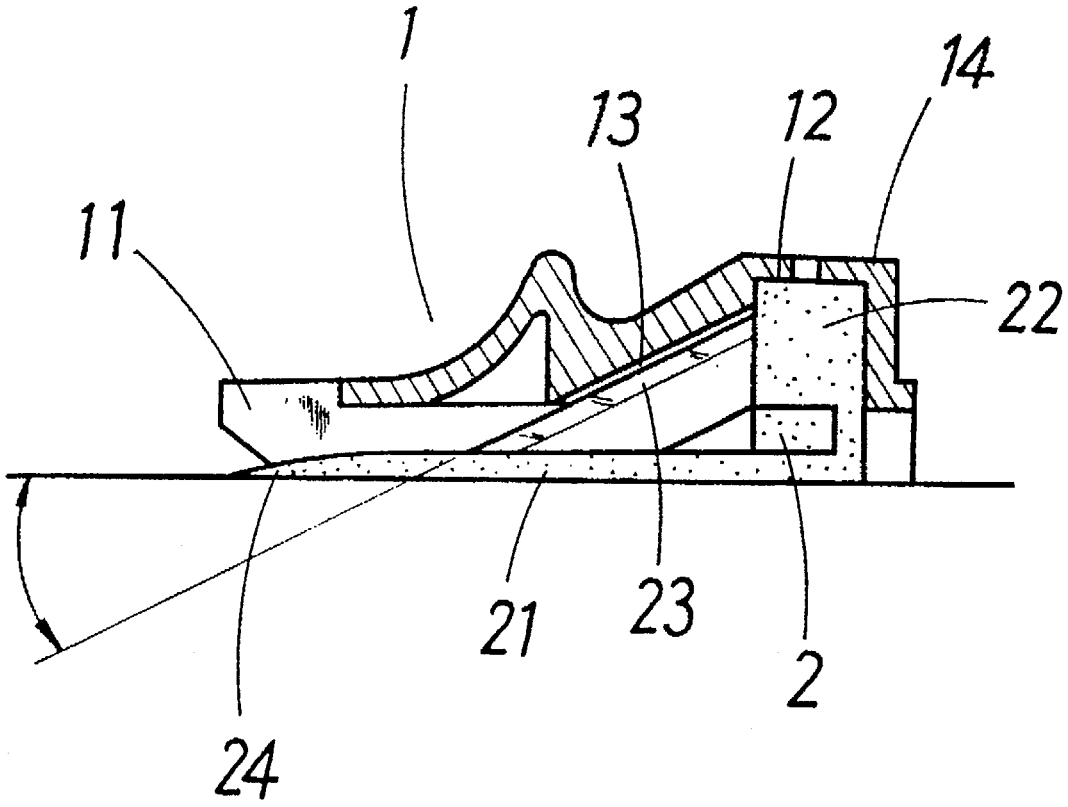
FIG. 3 is a side sectional view of the present invention.

As shown in FIG. 3, the whole cutting means 2 is received in the first recess of the holder 1 between the two side parts 11 with the engaging block 22 engaged into the second receiving recess 12 and the blade 23 extending closely below and in the same direction as that of the blade groove 13, such that a small clearance is left between the blade groove 13 and a top edge of the blade 23 and the pointed front end 24 of the bottom blade holder 21 adequately projects from two front ends of the two side parts 11.

Figure 4:
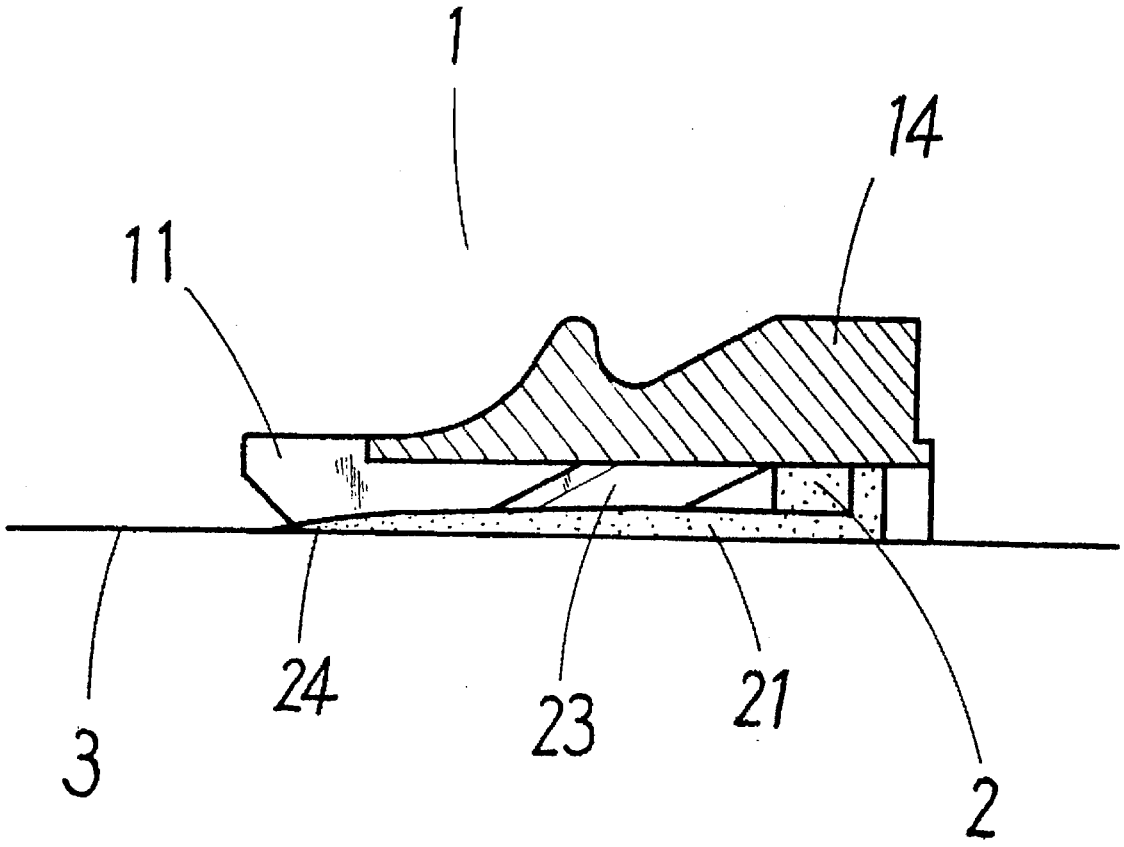
FIG. 4 illustrates the manner in which the present invention is used to cut a sheet of paper.
Figure 5:
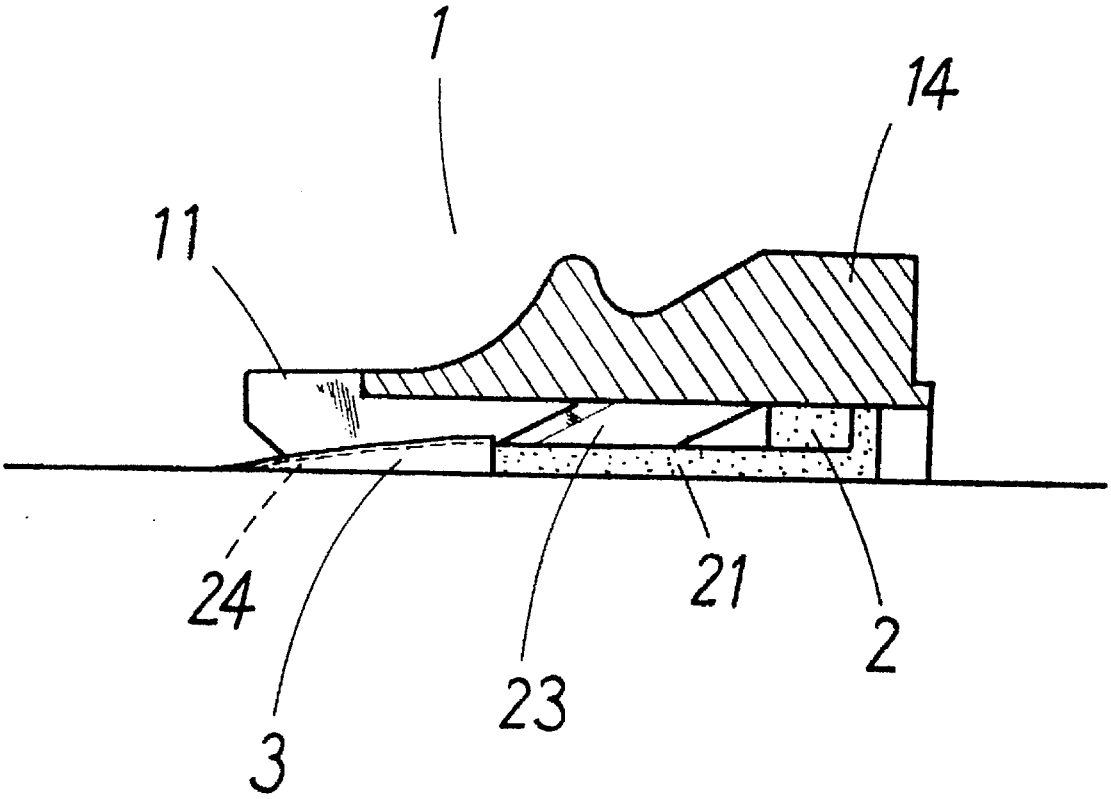
FIG. 5 is similar to FIG. 4, showing the cutter of the present invention is cutting the paper.

To use the present invention to cut a sheet of paper 3, first hold two sides of the holding part 14 with a thumb and a middle finger and press against the front stop part with an index finger. Then, referring to FIGS. 4, 5 and 6 for the operation of the present invention to cut the paper 3, the present invention is held and positioned in front of the paper 3 with the pointed front end 24 of the cutting means 2 extending into a bottom side of the paper 3. Paper at two sides of the pointed front end 24 are firmly pressed beneath the two side parts 11 of the holder 1. Push the whole present invention forward so that the paper 3 is guided by the pointed front end 24 of the cutting means 2 to move toward the blade 23. Since the blade 23 is disposed along a longitudinal axis of the holder 1 at an backward and upward inclined angle of from about 15 degrees to about 35 degrees, the paper 3 can be easily cut and separated by the blade 23 simply with the push force applied on the holder 1.

Figure 6:
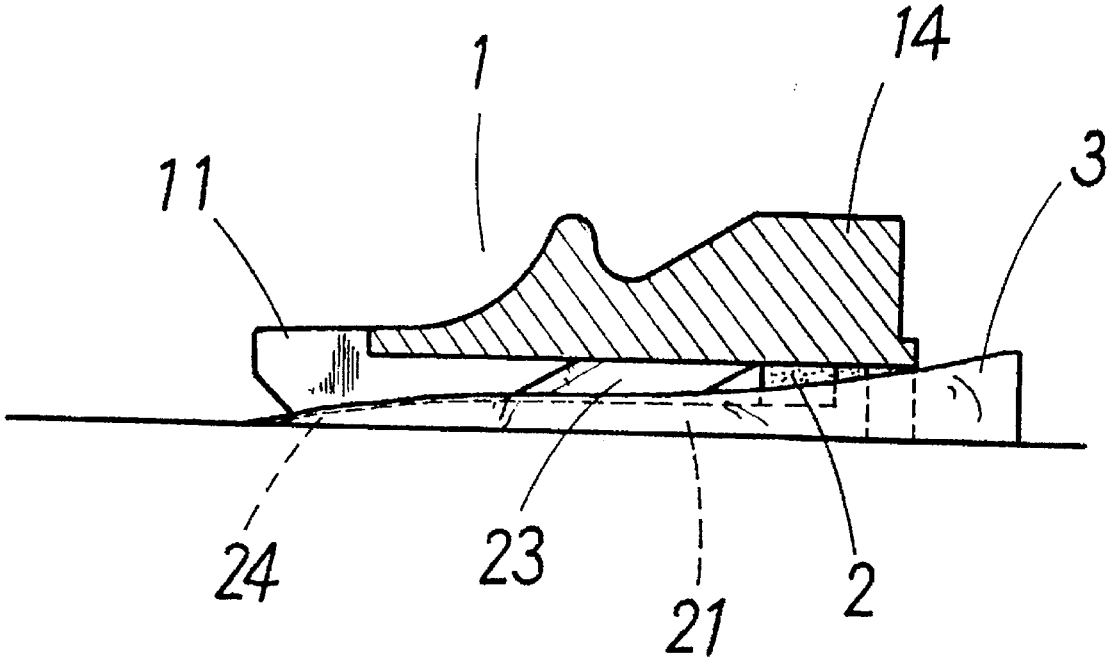
FIG. 6 is similar to FIGS. 4 and 5, showing the cutter is passing and cutting through the paper.

The separated paper 3 shall smoothly exposes from the rear end of the holder 1, as shown in FIG. 6.

The present invention is specially designed to cut a roll wrappage. A roll wrappage is a continuous wrappage rolled into a cylindrical body, that is, a roll. When the roll wrappage is to cut into two separate parts in a longitudinal direction, the wrappage is pulled out to a desired length to cut, put the present invention at a position near the begining end of of the roll wrappage with the front end of the holder 1 pointing outward. Then, the present invention is safely pushed from an inner position (near the user) toward an outer position, and the extended roll wrappage 3 is quickly cut to two separate parts. No ruler is needed in cutting the wrappage paper 3 while the paper can be cut straight and smooth.

The present invention is characterized in the blade 23 disposed at an inclined angle from about 15 degrees to about 35 degrees. According to experiments, an angle within this range enables the blade to cut more easily than any other angles. In the event the blade 23 inclines at an angle smaller than 15 degrees, the blade 23 functions less sharper than it should have been. On the contrary, when the blade 23 is disposed at an angle larger than 35 degrees, it shall face a higher cutting resistance from the paper 3 and might even fail to cut the paper 3. The disposition of the blade recess 13 and the blade 23 at an inclined angle within the range from 15 degrees to 35 degrees is decided completely depending on the physical property of the paper 3 generally shown when it is under cutting.

What is claimed is:

1. A wrappage cutter comprising:

a holder having two parallel side parts for pressing against a paper disposed below said cutter to be cut, and a middle connection part extending between said two side parts, said middle connection part being formed at a top surface with a front stop part and a rear holding part extended backward from said stop part, said holding part having a narrow front end and a wide tail end and together with said front stop part forming a generally triangular holding area, and at a bottom side with a first recess between said two side parts, a second recess deeply inward extended into said first recess at a rear end thereof below said holding part, and a blade groove forward and downward extended from said second recess; and a cutting means including a bottom blade holder, an upright engaging block upward projected from a rear end of said bottom blade holder to form an L-shaped blade support, and a blade inclinedly fixed between said engaging block and said bottom blade holder to extend forward and downward to a front end of said holder with a pointed front end thereof adequately projecting from two front ends of said two side parts; said cutting means being completely received in said holder for use in a safe manner;

whereby said upright engaging block is firmly received in said second recess and said blade extends closely below said blade groove with a small clearance left between said blade groove and a top edge of said blade; said wrappage cutter can be easily operated by holding two sides of said holding part with a thumb and a middle finger and pressing against said front stop part with an index finger so that said cutter is pushed forward while a paper to be cut is guided by said pointed front end of said cutting means to move into said cutter and be cut and separated by said blade.

2. A wrappage cutter as claimed in claim 1, wherein said blade of said cutting means is inclinedly fixed between said engaging block and said bottom blade holder at an angle between 15 degrees and 35 degrees to best cut a paper.

* * * * *